US005261164A

United States Patent [19]

Bellegante

[11] Patent Number: 5,261,164

[45] Date of Patent: Nov. 16, 1993

[54] SWIVELED AXE AND HATCHET

[76] Inventor: Curtis L. Bellegante, 303 E. Bay St., Apt. #8, Charleston, S.C. 29401

[21] Appl. No.: 957,894

[22] Filed: Oct. 8, 1992

[51] Int. Cl.[5] ..... B26B 23/00

[52] U.S. Cl. ..... 30/308.1; 403/187

[58] Field of Search ..... 30/308, 308.1, 308.2, 30/308.3; 403/DIG. 3, DIG. 9, 187

[56] References Cited

U.S. PATENT DOCUMENTS

| | | | |
|---|---|---|---|
| 50,262 | 10/1865 | Monson . | |
| 115,532 | 5/1871 | Sears . | |
| 1,074,764 | 10/1913 | Winship | 30/308.2 |
| 1,189,005 | 6/1916 | Seely | 30/308.2 |
| 1,614,949 | 1/1927 | Finley | 30/308.2 |
| 2,763,517 | 9/1956 | Strand | 403/187 |
| 2,804,109 | 8/1957 | Fatica | 30/308.1 |
| 4,950,100 | 8/1990 | Horgas | 403/DIG. 9 |
| 4,958,540 | 9/1990 | Davis . | |

*Primary Examiner*—Douglas D. Watts
*Assistant Examiner*—Paul M. Heyrana, Sr.
*Attorney, Agent, or Firm*—Michael K. Gray

[57] ABSTRACT

A swivel axe having a swivel shaft which is attached to a striking means at one end of the swivel shaft. A holed-flange is provided at a connecting end of the swivel shaft. The swivel shaft and a main shaft are connected by means of a ball-lock-pin which is inserted through the hole in the holed-flange and a hole in the connecting end of the main shaft. A push button latch release allows the swivel shaft to rotate upon the ball-lock-pin. Means are provided to lock the swivel shaft in vertical relation to the main shaft so that the striking member attached to the swivel shaft will not reverse momentum upon impact with an object.

8 Claims, 2 Drawing Sheets

SWIVELED AXE AND HATCHET

BACKGROUND OF THE INVENTION

1. Field of the Invention

The present invention pertains to striking instruments, such as axes and sledge hammers, and more particularly relates to a striking instrument having a pivoted striking member which is attachable and detachable to a main shaft.

2. Discussion of the Background

The prior art has demonstrated a number of devices which purport to increase or intensify the force of a blow delivered by an axe, hammer, or other striking member.

U.S. Pat. No. 50,262 to Monson discloses a hammer in which the hammer head is pivotally attached to the hammer handle. The pivotal nature of the invention is intended to enable a user to strike an object with greater force without increasing muscular exertion. In addition, a coil spring is provided at the pivot joint which recoils when the hammer is raised so that additional momentum is provided to the hammer head as it is accelerated towards its intended object.

U.S. Pat. No. 115,532 to Sears discloses an improvement in axe handles in which the axe handle is provided with a flexible joint which borders a rubber block. The flexible joint is comprised of a loop which is part of an iron tenon which is inserted into the axe head. The iron tenon is bolted to the wooden region of the axe handle. The flexible joint further includes a pivot hook which locks around the loop, with a shank region of the pivot hook being riveted to the wooden region of the handle. The invention is intended to allow a user to strike an object without the shock and jar vibrations incident in such activity reverberating back to the user's hands. Thus, a user can exert greater force in a given blow.

U.S. Pat. No. 4,958,540 to Davis discloses an improved hammer device for improved impact which is comprised of three shanks. A first shank includes a handle, with a middle shank being integrally connected at a predetermined angle to the first shank. A third shank, which includes the hammer head, is connected at a predetermined angle to the second shank. The invention is intended to increase the striking force of the hammer.

Often firemen and rescue workers use axes during the course of their duties. It is often desirable that the axes and striking instruments deliver a maximum blow so that less time is spent in striking an object. Furthermore, firemen and rescue workers are sometimes placed in tight and cramped areas where a full blow cannot be used. In such instances, it would be beneficial if they had ready access to a hatchet means for performing a given job function.

One problem of a pivotable striking device is that the striking head will have a propensity to recoil upon hitting the object of impact so that the momentum of the striking object is reversed and less striking energy is imparted to the impacted device.

Thus, a need is seen for a striking device which will impart a great striking force upon an impacted object and not reverse momentum upon impacting the object. Further, a need is seen for a full size striking device having a detachable means which enables a detachable portion to be used as a hatchet.

SUMMARY OF THE INVENTION

Accordingly, one object of the present invention is to provide a striking device which imparts a greater striking force than typical axes and hammers. Another object of the present invention is to provide a striking device which has a detachable swivel shaft which can be used as a hatchet.

Still another object of the present invention is to provide a pivotally connected striking member which will not reverse momentum upon impact with an object.

These and other valuable objects and advantages of the present invention are provided by a striking device having a main shaft which has a connecting end. A swivel shaft, to which is connected a striking member, can be pivotally attached to the main shaft by a pivotally attaching means (a ball-lock-pin) which allows the swivel shaft to rotate upon it when the swivel shaft is in an unlocked or unlatched position in relation to the main shaft. Alternatively, the pivotally attaching means can be removed from the swivel shaft and the main shaft which allows the swivel shaft to be used as a hatchet or similar device.

The striking device has a means for latching which includes a spring member and a latch connected to the spring member, the latch and the spring member are provided in a connecting end of the swivel shaft. The connecting end of the swivel shaft is further provided with ribs for engaging grooves in the connecting end of the main shaft to provide greater rigidity when the main shaft is in a latched, substantially vertical position in relation to the main shaft. The striking device of the present invention is provided with means for unlatching or unlocking the main shaft from the swivel shaft so that the swivel shaft is free to rotate on the means for pivotally attaching. The means for unlatching includes a latch release which is connected to a spring in the connecting end of the swivel shaft.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

When referring to the drawings, it should be understood that like reference numerals designate identical or corresponding parts throughout the respective references.

DETAILED DESCRIPTION OF THE INVENTION

Figure 1:
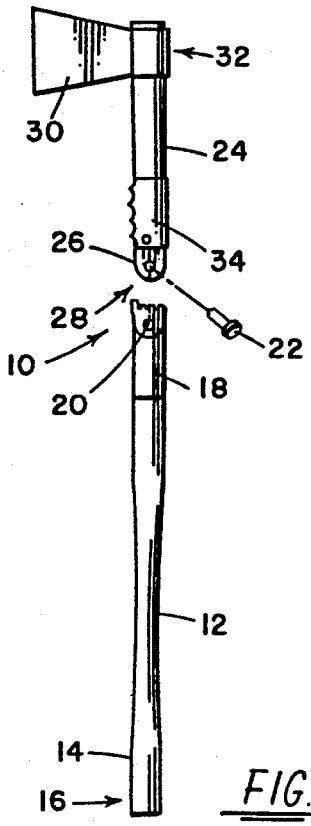
FIG. 1 is an exploded view of the present invention.

With reference to FIG. 1, the swivel axe 10 according to the present invention has a main shaft 12 having a shaft handle 14 at the handle end 16 of the main shaft 12. A top end or connecting end 18 of the shaft 12 is provided with a hole 20 for insertion of a ball-lock-pin 22. A swivel shaft 24 is provided with a holed-flange 26 at the connecting end 28 of the swivel shaft 24 and is provided with a striking member 30 at its striking end 32. The striking member can take the form of a regular axe head, a firemen's axe head, a sledge hammer, a pick-axe, or any other type of desired striking member.

The swivel shaft is further provided with a finger grip 34 for allowing a user to better grasp the swivel shaft 24 when the swivel shaft 24 is detached from the main shaft 12. The hole 36 provided in the holed-flange 26 and the hole 20 provided in the connecting end 18 of the main shaft 12 allow the ball-lock-pin 22 to pivotally secure the swivel shaft 24 to the main shaft 12. The ball-lock-pin provides a pivot point upon which the swivel shaft 24 rotates when the swivel shaft 24 is in an unlatched position.

The main shaft 12 has a safety line which marks a position on the main shaft 12 below which the main shaft 12 is tapered. Both the main shaft 12 and the swivel shaft 24 are made of a strong, light-weight aluminum alloy or other appropriate material so that most of the weight of the swivel axe 10 is located at the striking end 32. The main shaft 12 represents approximately two-thirds of the total length of the swivel axe 10, with the total length of the swivel axe being approximately 9 inches longer than a conventional axe to allow for greater torque.

Figure 2:
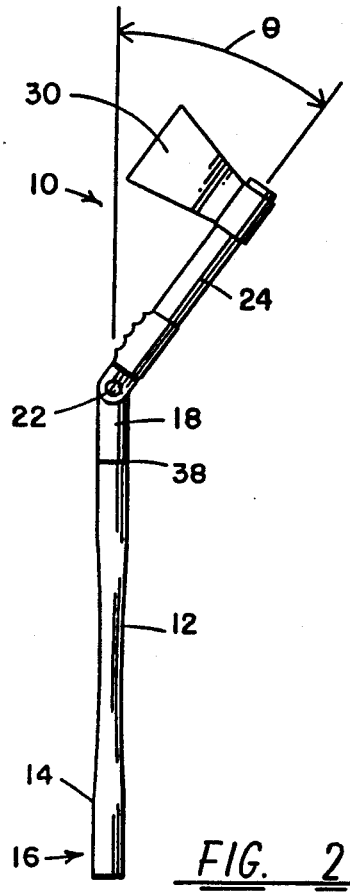
FIG. 2 is a schematic illustration of the present invention which demonstrates the swivel shaft of the present invention being in a non-vertical position in relation to the main shaft of the device.

With reference to FIG. 2, the swivel shaft 24 and striking member 30 have been rotated backward in non-vertical relation to the main shaft 12. The angled position, indicated by the angle Θ, of the striking member 30 and swivel shaft 24 (FIG. 2), in relation to the main shaft 12, is illustrative of how the swivel axe 10 is oriented when an individual swings the swivel axe 10 back before striking an object.

Figure 3:
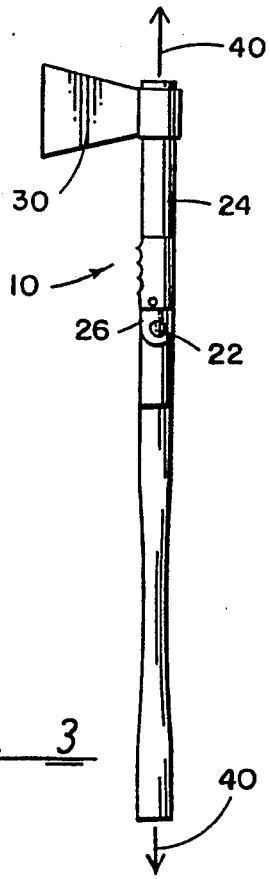
FIG. 3 is a schematic illustration demonstrating the swivel shaft of the present invention in vertical relation to the main shaft of the present invention.

In FIG. 3, the swivel shaft 24 and the main shaft 12 are in a latched, vertical relation to one another in that a straight line, indicated by numeral 40, can be drawn through the entire length of both the swivel shaft 24 and the main shaft 12.

Figure 4:
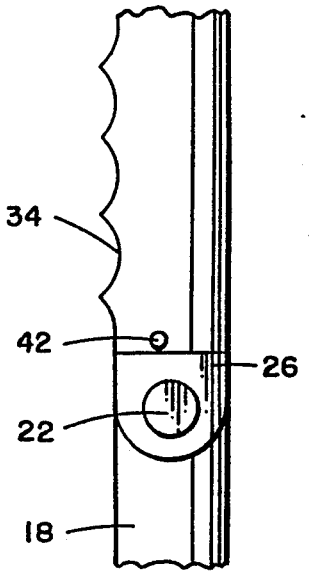
FIG. 4 is a schematic illustration demonstrating the ball-lock-pin interface of the swivel shaft and main shaft of the present invention.

With reference to FIG. 4, the finger grip 34 of the swivel shaft 24 is provided with a push button latch release 42 which is located immediately above the holed-flange 26. The holed-flange 26 is connected to the connecting end 18 of the main shaft 12 by means of ball-lock-pin 22.

Figure 5:
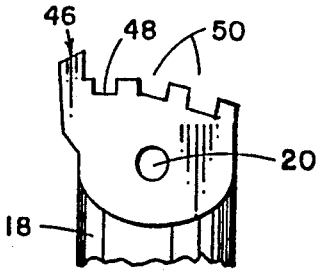
FIG. 5 is a schematic illustration of the top end region of the main shaft of the present invention.

In FIG. 5, the connecting end 18 of main shaft 12 is provided with a recessed area 44 which is located on both sides of the main shaft 12 (only one side is shown is FIG. 5) to accommodate the connecting end 28 of swivel shaft 24. The recessed area 44 is provided with a stop 46, a catch 48, and a plurality of grooves 50. The stop 46 prevents the shaft 24 from traveling past a vertical position. Grooves 50 are sloped downward for accomodating the latch 52 (see FIG. 7) in the event that the swivel shaft 24 is not swung with sufficent force to obtain the full vertical position demonstrated in FIG. 3. Thus, when the swivel shaft 24 is attached to the main shaft 12 by means of the ball-lock-pin 22, the stop 46 will prevent the swivel shaft 24 from proceeding forward beyond the vertical position indicated by line 40 in FIG. 3.

Figure 6:
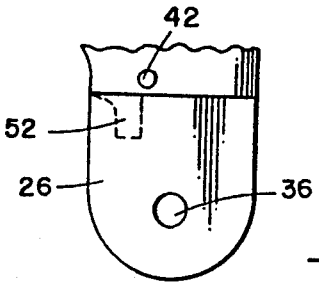
FIG. 6 is a schematic illustration of the holed-flange and flange end region of the swivel shaft according to the present invention.

In FIG. 6, a closeup schematic illustration demonstrates that latch member 52 extends from the swivel shaft 24 of the present invention so as to be positioned just inside of the holed-flange 26.

Figure 7:
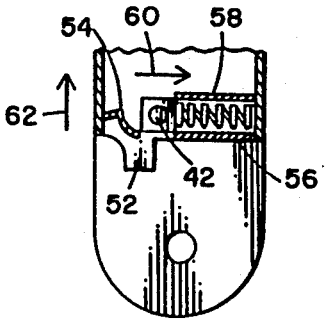
FIG. 7 is a cross-sectional illustration taken along line 7—7 of FIG. 6 and illustrates the spring loaded latch according to the present invention.

FIG. 7 is a cross-sectional illustration taken along line 7-7 of FIG. 6. FIG. 7 illustrates that a spring member 54, located inside of the swivel shaft 24 and connected to a cavity wall therein, is connected to latch 52. A spring 56 connected to and housed inside a spring housing 58 is attached to the push button latch release 42.

When latched release 42 is pushed in the direction indicated by arrow 60 (FIG. 7), spring member 54 causes the latch 52 to move in an upward direction indicated by arrow 62. When the latch 52 is in a locked position upon the swivel shaft 24 and main shaft 12 ls swung forward with sufficient force so that the swivel shaft 24 assumes the vertical position of FIG. 3, the latch 52 becomes secured in the catch 48 (FIG. 5) which is located at the top of the connecting end 18 of main shaft 12. To release latch 52 from the catch 48, latch release 42 is pulled in the direction indicated by arrow 60. The swivel shaft 24 and striking member 30 may now rotate backwards on the pivotal axis provided by ball-lock-pin 22. Then when the swivel axe 10 is swung forward, such as when striking an object, the latch 52 will once again become locked in the catch 48.

Thus, in operation a user can press the latch release 42 to free the swivel shaft 24 from its locked vertical position in relation to the main shaft 12. As the swivel axe 10 is drawn backward immediately prior to striking an object, the swivel shaft 24 rotates backward so as to make an angle Θ with the main shaft 12 (see FIG. 2). As the swivel axe is swung forward, the striking member 30 is accelerated forward and the latch 52 becomes locked in catch 48 before the striking member 30 impacts an object. The stop 46 prevents the swivel shaft 24 and striking member 30 from going past a vertical position in relation to the main shaft 12. The latch 52, catch 48, and stop 46 provide a locking means which prevents the striking member 30 from reversing momentum upon impact with an object. After striking an object, if it is desired to strike the object once again, a user simply presses the latch release 42 and then proceeds to swing at the object.

Figure 8:
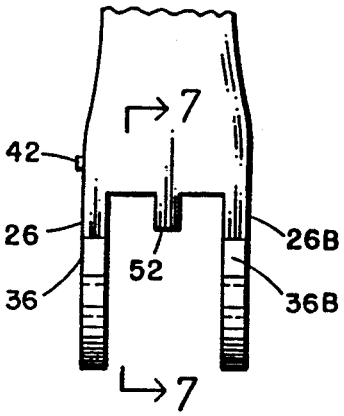
FIG. 8 is a frontal view of the swivel shaft and holed-flange according to the present invention.

FIG. 8 is a frontal illustration of the connecting end 28 of swivel shaft 24. Holed flange 26 and holed flange 26B are provided at opposite sides of the swivel shaft 24. A ball-lock-pin 22 (FIG. 1) is inserted through the hole 36 in holed flange 26, through the hole 20 of the connecting end 18 of main shaft 12, and out through the hole 36B of holed flange 26B where it is locked in place. The ball lock pin 22 then acts as an axis upon which the swivel shaft 24 may pivot. By removing the ball-lock-pin 22, the swivel shaft and striking member 30 can be used as a hatchet (see FIG. 1), with the finger grip 34 providing a gripping means to the user. Ball-lock-pins are well known devices which allow for easy manual insertion and removal from an object.

Figure 9:
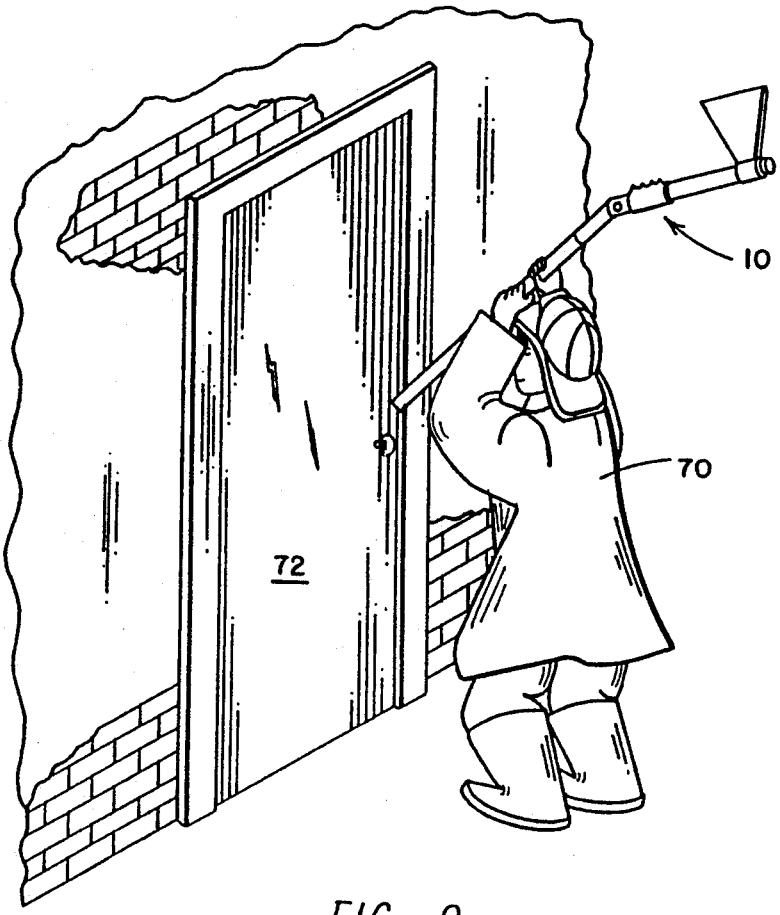
FIG. 9 is an exemplary illustration depicting how the swivel axe of the present invention is used.

FIG. 9 is an exemplary illustration depicting a fireman 70 swinging the swivel axe 10 of the present invention for purposes of striking a door 72.

The present invention, in recognizing that Force =mass ×acceleration, makes use of a rotational acceleration component provided by the rotating swivel shaft 24 to increase the amount of force imparted to an object which is struck by the striking member 30.

Thus, the swivel axe 10 of the present invention allows greater force to be delivered by an axe blow and further allows a quickly accessible hatchet means for use in tight and cramped quarters. The present invention is an extremely beneficial aid to the tasks of rescue and fire workers. The only maintenance required for the present invention is that the ball-lock-pin 22 by occasionally oiled.

The foregoing detailed description of the present invention is intended to be illustrative and non-limiting. Many changes and modifications are possible in light of the above teachings. Thus, it is understood that the invention may be practiced otherwise than is specifically described herein and still be within the scope of the appended claims.

What is claimed is:

1. A swiveled striking device for use by an individual in striking an object, said device comprising:

a main shaft having a connecting end;

a swivel shaft having a connecting end;

means for pivotally connecting the connecting end of said main shaft to the connecting end of said swivel shaft such that when said swiveled striking device is drawn backward by an individual immediately prior to striking the object said swivel shaft is drawn backward to an angle Θ behind said main shaft;

means for latching said main shaft to said swivel shaft upon said striking device being accelerated by a forward swing of the individual toward the object to be struck such that said swivel shaft and said main shaft are in a locked substantially vertical position with respect to one another; and means for unlocking said main shaft and said swivel shaft from said lock substantially vertical position.

2. A swiveled striking device, according to claim 1, further comprising:

a striking member connected to the swiveled shaft.

3. A swiveled striking device according to claim 2, wherein said means for pivotally connecting comprises a ball-lock-pin which is inserted through the connecting end of said swivel shaft and through a hole in the connecting end of said main shaft, said ball-lock-pin being quickly and easily manually removable from said swivel shaft and said main shaft to allow said swivel shaft to be used as a separate striking instrument.

4. A swiveled striking device according to claim 3, further comprising:

a finger grip provided on the swivel shaft to provide better gripping so that when detached from said main shaft said swivel shaft and said striking member may be utilized as a hatchet.

5. A swiveled striking device according to claim 1, wherein: said means for latching comprises:

a spring member;

a latch connected to said spring member, said spring member and latch connecting to the connecting end of said swivel shaft; and a catch provided in the connecting end of said main shaft.

6. A swiveled striking device according to claim 5, wherein the connecting end of said main shaft further comprises:

a stop for preventing further forward movement of said swivel shaft.

7. A swiveled striking device according to claim 1, wherein said means for unlocking comprises:

a latch release connected to a spring provided in a spring housing in the interior of said swivel shaft.

8. A swiveled striking device for manual use by an individual for imparting a greater striking force to an object as a result of an added rotational acceleration of a striking member, said device comprising:

a main shaft having a connecting end;

a swivel shaft connected to the striking member at one end and having a connecting end at its other end;

means for pivotally connecting the connecting end of the main shaft with the connecting end of the swivel shaft such that when said swiveled striking device is drawn backwards by an individual immediately prior to striking an object said swivel shaft is rotated to a backward position in relation to said main shaft;

means for latching said swivel shaft and said main shaft in a locked, substantially vertical position with respect to one another after said striking device is swung forward by an individual so that said swiveled shaft and the striking member are accelerated forward from the backward position to impart an added force upon the struck object, said means for latching further preventing recoil and reverse of momentum of the striking member upon the striking member impacting the struck object; and means for unlocking said main shaft and said swivel shaft from said locked, substantially vertical position.

* * * * *